United States Patent [19]

Emmons

[11] 4,044,813

[45] Aug. 30, 1977

[54] ATTACHMENT MEANS FOR SCREEN OR STORM WINDOW

[76] Inventor: Oren L. Emmons, Rte. 4, 44th St., Allegan, Mich. 49010

[21] Appl. No.: 694,697

[22] Filed: June 10, 1976

[51] Int. Cl.[2] ..... A47H 3/00

[52] U.S. Cl. ..... 160/369; 160/354; 160/368 R; 24/208 R; 24/220; 248/466

[58] Field of Search ..... 160/368 R, 369, 354; 16/2, 108; 24/DIG. 17, 73 HS, 73 P, 73 PF, 73 S, 141, 202, 208 A, 208 R, 213 R, 213 B, 214, 216, 217, 219, 220; 248/466

[56] References Cited

U.S. PATENT DOCUMENTS

| | | | |
|---|---|---|---|
| 657,793 | 9/1900 | Shade et al. | 24/141 |
| 1,977,165 | 10/1934 | Williams | 160/369 |
| 2,321,078 | 6/1943 | Greene | 160/354 |
| 2,717,792 | 9/1955 | Pelley | 16/2 |
| 3,118,644 | 1/1964 | Wernig | 24/208 A |
| 3,166,116 | 1/1965 | Cole, Jr. | 160/369 |
| 3,251,103 | 5/1966 | Saut | 24/73 HS |

*Primary Examiner*—Peter M. Caun

[57] ABSTRACT

A screen or storm window attachment system comprising a snap-type attachment means mounted so as to allow for dimensional changes in the casing on which it is detachably mounted. The snap-type attachment means is mounted flexibly near the perimeter of the screen or storm window, and includes means to accurately position the mating snap portion to be mounted on the window casement. This system may be used on the inside or outside of existing window casings.

9 Claims, 5 Drawing Figures

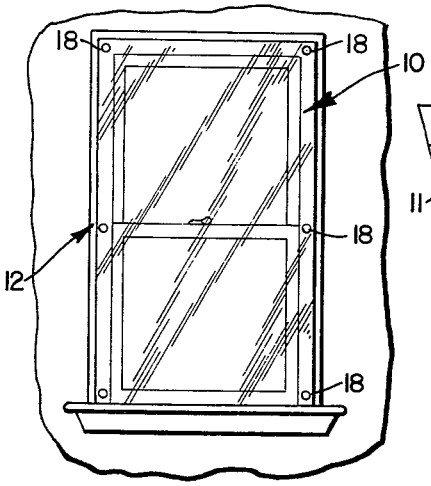
FIG. 1
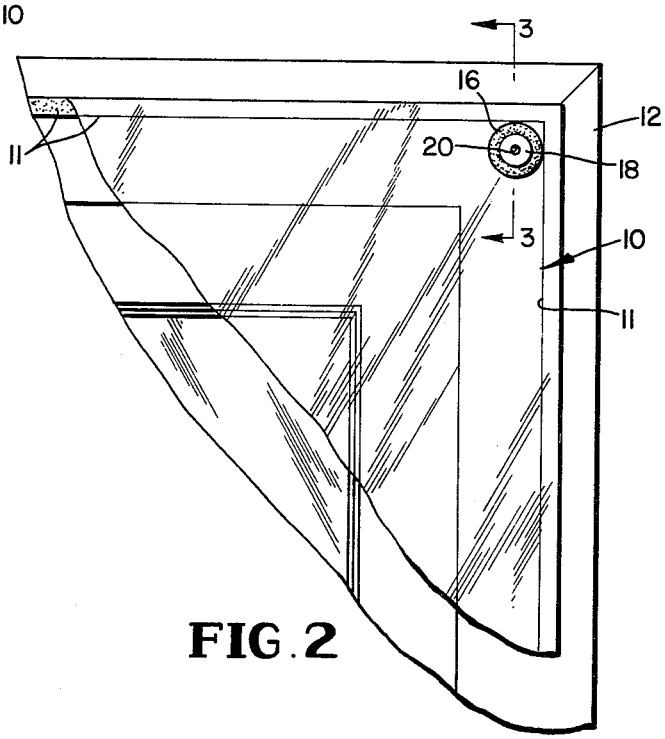
FIG. 2
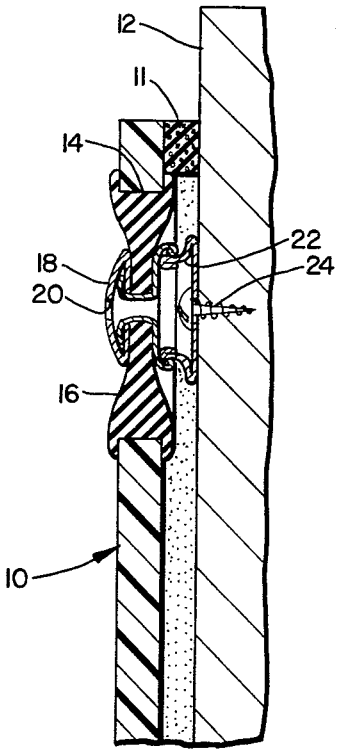
FIG. 3
FIG. 4
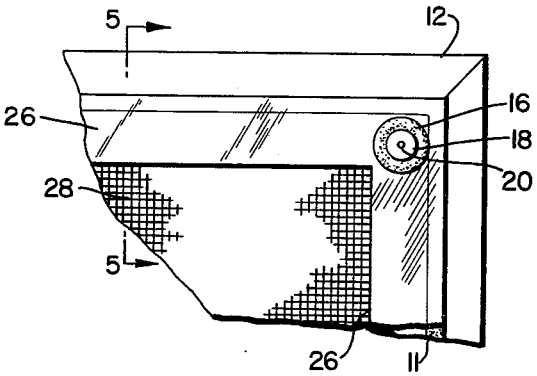
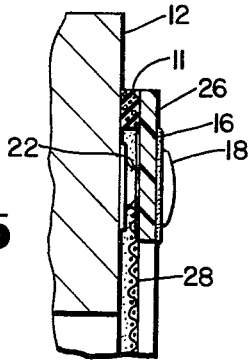
FIG. 5

ATTACHMENT MEANS FOR SCREEN OR STORM WINDOW

BACKGROUND OF THE INVENTION

This invention relates to means for mounting a screen and/or storm window and, more particularly, to snap-type attachment means for mounting a screen or storm window on a window frame.

Screen and/or storm windows which are alternated with the seasons are a constant headache to the home owner owing to dimensional changes in the window casements on which they are mounted resulting from changes in temperature and humidity. These dimensional changes necessitate shaving or planing of the window frame or casement and may result in gaps which allow insects or winter winds to enter.

By means of a snap-type attachment system which is mounted so that one portion of the snap system absorbs or compensates for the dimensional changes encountered, a weatherproof sealing strip around the perimeter of the storm window or screen, these fitting problems are resolved in accordance with the teachings of the present invention. Also, the windows or screens constructed in accordance with this invention may be mounted either inside or outside existing window casements for ease of mounting or demounting, and require only an unobtrusive fastening means to be attached to the existing casing which may be left in place or removed seasonably as desired.

SUMMARY OF THE INVENTION

The screen or storm window preferably is made from a sheet of acrylic plastic or similar material. Alternately a light metal frame and conventional window glass or screen may be used. Around the perimeter of the screen or storm window is affixed a soft weatherproofing strip of felt, foam rubber or another suitable material held in place by waterproof adhesive, mechanical means, or other suitable means. A snap fastening means is provided spaced at suitable intervals around the perimeter of the window or screen frame for attachment to mating fastener means affixed to the window casement. The portion of the fastener that is attached to the storm window or screen frame is mounted through a flexible grommet formed of rubber or another suitable material which allows this portion of the snap fastener means to move within a reasonable radius from its central position. This movable portion of the snap fastening means allows for seasonal changes in the dimension of the window casement and resultant dislocation of the mating snap fastening affixed to the casement, with no difficulty being experienced in installing or removing the storm window or screen.

For initial installation of the snap fastener means on the window casement, a small hole is provided in the snap fastener portion which is attached to the storm window. This hole allows match drilling or marking for the correct initial location of the mating fastener portion that is to be attached to the casement. When installed, this hole is, of course, closed off from entrance of insects or cold air by the fastener portion attached to the casement.

BRIEF DESCRIPTION OF THE DRAWING

FIG. 1 is an elevational view of a storm window mounted on a window frame with the use of the attachment means of the present invention;

FIG. 2 is an enlarged partial elevational view of the storm window shown in FIG. 1;

FIG. 3 is a sectional view taken substantially along line 3—3 in FIG. 2;

FIG. 4 is a view similar to FIG. 2, showing a screen with the attachment means of the present invention; and FIG. 5 is a sectional view taken substantially along line 5—5 in FIG. 4.

DESCRIPTION OF THE PREFERRED EMBODIMENTS

Referring now to FIGS. 1-3 of the drawing, a clear sheet of a suitable material such as an acrylic material of suitable thickness and rigidity is provided as a suitable storm window material. A flexible weather strip 11 of felt, foam rubber or other suitable material is affixed by a suitable adhesive or mechanical means around the perimeter of the sheet 10 where it will come in contact with the window casing 12.

Holes 14 are provided in the sheet 10 at suitable intervals, and a flexible grommet 16 of rubber or another suitable material is mounted in each hole 14 as shown in FIG. 3.

The female portion 18 of a snap fastener of any suitable construction preferably similar to those used for heavy duty purposes on clothing or canvas items, is provided with a hole 20 in the center of the external cap portion thereof. A female snap portion 18 is mounted substantially in the center of each grommet 16 in a conventional manner, as shown in FIG. 3.

The matching male portion 22 of the snap fastener is attached to the window casing 12 by means of a screw 24 of any other suitable fastening means.

Alternatively, as shown in FIGS. 4 and 5, a lightweight storm window or window screen frame 26 having a screen 28 and/or window may be used in place of the sheet 10, with the same fastening system being utilized as shown in FIG. 3.

In operation, the storm window sheet 10 or screen or window frame 26 is placed against the window casing 12 either on the exterior or on the interior of the building. The position of each male snap fastener portion 22 is marked on the casing 12 or match-drilled through the hole 20 in each female snap fastener portion 18 in the storm window 10 of screen frame 26. The male portions 22 of the snap fasteners then are installed on the window casing 12 by means of screws 24 or other suitable means and the storm window or screen is snapped in place, the weatherstipping 11 conforming to any irregularities in the window casing 12.

As the seasons change and the storm windows are alternately removed and replaced, the rubber grommets 16 provide for adequate movement of the female snap fasteners 18 to compensate for displacement of the casing-mounted male snap portions 22 so that no refitting is required.

It is understood that this invention is not confined to the particular construction and arrangement of parts herein illustrated and described, but embraces such modified forms thereof as come within the scope of the following claims.

What is claimed is:

1. In a screen or storm window device that is removably mountable on first attachment means on a window casing or the like, the improvement wherein the periphery of the device is provided with a plurality of apertures therethrough disposed in spaced relation, a flexible and resilient grommet is mounted within each of said apertures, and second attachment means is secured to each grommet and is releasably engageable with said first attachment means, said grommets serving to enable movement of said second attachment means to insure proper mating of said first and second attachment means.

2. The device of claim 1 wherein said first and second attachment means are snap fastener means.

3. The device of claim 1 wherein said second attachment means is secured to each grommet substantially at the center portion thereof.

4. The device of claim 1 wherein each of said second attachment means is provided with an opening therethrough substantially at the center portion thereof, said opening serving to facilitate the positioning of the first attachment means on the window casing prior to the mounting of the device thereon.

5. The device of claim 1 wherein weatherproofing means is mounted on the peripheral surface of said device that is adapted to be disposed adjacent to the window casing.

6. The device of claim 5 wherein said weatherproofing means is a flexible strip.

7. The device of claim 1 wherein said device is a clear sheet.

8. The device of claim 7 wherein said sheet is formed of plastic material.

9. The device of claim 8 wherein said sheet is formed of an acrylic material.

* * * * *